United States Patent [19]

Hamazaki

[11] Patent Number: 4,625,739

[45] Date of Patent: Dec. 2, 1986

[54] WIG ATTACHING MEMBER

[76] Inventor: Koji Hamazaki, 431-1, Manjojiki-cho, Fukakusa Oogamedani, Fushimi, Japan

[21] Appl. No.: 688,135

[22] Filed: Jan. 2, 1985

[51] Int. Cl.[4] ..... A41G 5/00

[52] U.S. Cl. ..... 132/54

[58] Field of Search ..... 132/53, 54, 55, 56, 132/5

[56] References Cited

U.S. PATENT DOCUMENTS

| | | | |
|---|---|---|---|
| 1,464,089 | 8/1923 | Ernest | 132/53 |
| 2,149,170 | 2/1939 | Gould | 132/53 |
| 2,242,420 | 5/1941 | Di Giovanna | 132/53 |
| 3,046,999 | 7/1962 | Lint | 132/54 |
| 3,419,020 | 12/1968 | Courtney | 132/54 |
| 3,788,332 | 1/1974 | Abbott et al. | 132/54 |
| 4,155,370 | 5/1979 | Nemoto | 132/53 |
| 4,168,713 | 10/1979 | Agiotis | 132/53 |
| 4,176,669 | 12/1979 | Levin | 132/53 |
| 4,360,033 | 11/1982 | Schmehling | 132/53 |

*Primary Examiner*—Robert P. Swiatek
*Assistant Examiner*—Carolyn A. Harrison
*Attorney, Agent, or Firm*—Birch, Stewart, Kolasch & Birch

[57] ABSTRACT

A wig attaching member to be fixed to an inner surface of a wig when in use, comprising a piece of elastically deformable, substantially convexo-concave sheet-like member which is defined by a smoothly continuous curved marginal edge, a substantially spherical external convex surface and a substantially spherical internal concave surface to provide an internal space serving as a vacuum chamber which is formed when the member is pressed against a bald area of a person's head.

8 Claims, 11 Drawing Figures

WIG ATTACHING MEMBER

BACKGROUND AND SUMMARY OF THE INVENTION

This invention relates to a wig attaching member, and more particularly to improvements in the wig attaching member by means of which a wig body can be detachably secured to a bald area of a person's head.

As is well known and disclosed for example in U.S. Pat. No. 4,176,669 to Levin, a wig can be secured to the head by means of an adhesive or a pressure sensitive double-sided adhesive tape applied directly to an inner surface of the wig body. This technique, however, suffers from a number of disadvantages. More specifically, a wearer always feels uncomfortable because of the direct sticking of the adhesive or the tape to his scalp. Further, application of the adhesive or the tape is a troublesome and time-consuming job in addition the adhesive or the tape should be replaced every time the wig is removed. Furthermore, the wig may unexpectedly falls off the wearer's head occasionally when his scalp is so sweaty as to cause decrease in stickness of the adhesive or the tape to the bald area of the head.

Another technique for securing a wig to a person's head is based on use of a plurality of mechanical anchoring members, as disclosed for example in U.S. Pat. Nos. 4,155,370 to Nemoto, 4,168,713 to Agiotis and 4,360,033 to Schmehling. However, this technique also suffers from a number of disadvantages. More specifically, a troublesome and time-consuming job is required to wear or remove the wig. In other words, the technique does not permit instantaneous attachment and detachment of the wig by one touch operation. Further, the wearer does not always feel comfortable when the wig is secured to his head by the mechanical anchoring members. Furthermore, this technique cannot be applied when a wearer's head is substantially fully bald and has no hair to which the wig is to be anchored.

In addition to the above-discussed prior art techniques, various other conventional techniques have also been proposed, which are not easy to use, not simple in construction, and expensive to manufacture.

It is, therefore, an object of the invention to substantially eliminate the above discussed disadvantages in the prior art techniques.

Another object of the invention is to provide an improved wig attaching member which can be fixed at its external convex spherical surface to an internal surface of a wig body so that the member with the wig body can be easily attached to or removed from a bald area of a wearer's head by one touch operation.

A further object of the invention is to provide an improved wig attaching member which can be applied even when a wearer's head is bald in its entire scalp.

A still further object of the invention is to provide an improved wig attaching member which can minimize a wearer's uncomfortable feeling in use.

Yet further object of the invention is to provide an improved wig attaching member which permits a firm attachment of the wig body to a bald area of a wearer's head without undesirable dislocation.

Still a further object of the invention is to provide an improved wig attaching member which is in the form of a simple one-piece member, not bulky, light in weight, and permits manufacture at a very low expense.

Other objects, features and advantages of the invention will become apparent from the detailed description given hereinafter in connection with the accompanying drawings.

According to the present invention, there is provided a wig attaching member to be fixed at its external convex spherical surface to an internal surface of a wig body by means of a known adhesive, a known double-sided adhesive tape or the like and to be attached at its internal concave spherical surface to a bald area of a wearer's head by forming a thin vacuum chamber between the surface of the scalp of the bald area and the internal concave spherical surface of the member, which is in the form of a piece of elastically deformable convexo-concave sheet-like member formed of synthetic resin material defined by a smoothly continuous curved marginal edge having no angular corner, the member being not bulky and light in weight, having an internal space which is defined by the internal concave spherical surface of the member and will cooperate with a part of the scalp of the bald area of the wearer's head to form a vacuum chamber therebetween, so that the member, which supports the wig, can be detachably attached to the bald area of the person's head by means of negative pressure produced in the vaccum chamber.

DESCRIPTION OF THE PREFERRED EMBODIMENTS

Referring now to the accompanying drawings, a wig attaching member according to the invention is illustrated as being a piece of elastically deformable, substantially convexo-concave sheet-like member 1 formed of synthetic resin material such as polyethylene for example. The member 1 may preferably be about 0.5 mm in wall thickness, about 5–15 cm in maximum length and defined by a smoothly continuous marginal edge 4 having no angular corner. Preferably, the marginal edge 4 as viewed horizontally from front side may be properly curved so as to extend substantially along the surface configuration of a bald area of a wearer's head to which the member 1 is to be attached.

Figure 1:
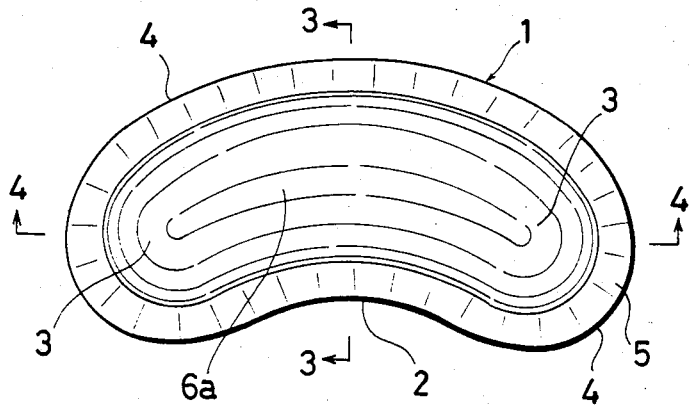
FIG. 1 is a top plan view of a wig attaching member according to the invention.
Figure 5:
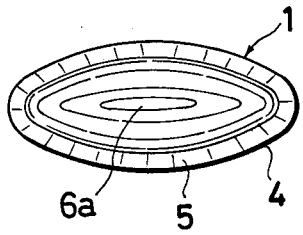
FIG. 5 is a top plan view showing a modified embodiment of the invention.
Figure 6:
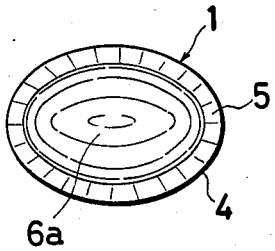
FIG. 6 is a top plan view showing another modified embodiment of the invention.

According to one embodiment as illustrated in FIGS. 1 thru 4, the member 1 as viewed from above curves in at its central portion to form an indentation 2 and swells out at its opposite sides to form a pair of promontories 3 located on either side of the indentation 2, as best shown in FIG. 1. It should be noted, however, such specific configuration of the member 1 as viewed from above is not limitative of the invention. The configuration of the member 1 may be varied in many ways. For example, the member 1 may be oval in its top plan view as shown in FIGS. 5 and 6 or substantially circular (not shown).

The member 1 may be provided with a certain width of flat surfaced (not curved in cross section) marginal zone 5 extending along the smoothly continuous curved marginal edge 4. A value of the width of the zone 5 may be about 0.5 mm for example but can be varied as desired.

Figure 7:
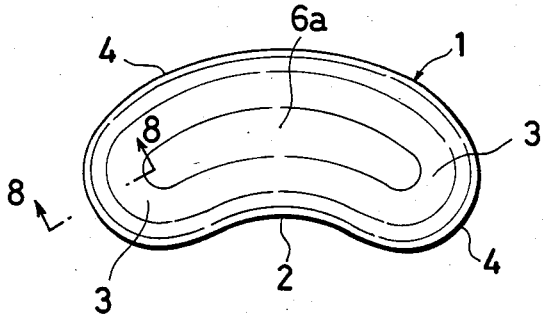
FIG. 7 is a top plan view showing a further modified embodiment of the invention.
Figure 8:
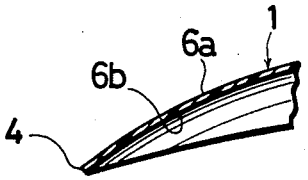
FIG. 8 is an enlarged fragmentary section taken along the line 8—8 of FIG. 7.
Figure 9:
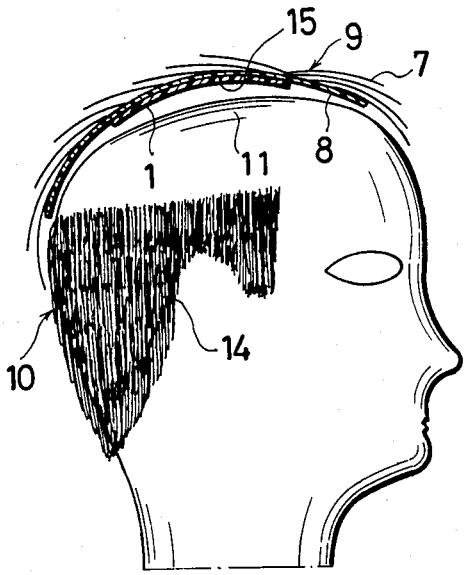
FIG. 9 is a schematic sectional side elevation showing how to use a wig with the wig attaching member before a vacuum chamber is formed.

The flat surfaced marginal zone 5 provides better hermetical seal for a vacuum chamber 13 to be hereinafter described, so that better adherence of the member 1 to a bald area of a wearer's head can be attained. However, provision of such marginal zone 5 is not always necessary. More specifically, in the case where the member 1 is flexible enough at its marginal edge to keep sufficient adherence of the member to the scalp of the bald area of the wearer's head, provision of the aforesaid flat surfaced marginal zone 5 is unnecessary, as illustrated in FIGS. 7 and 8.

Figure 2:
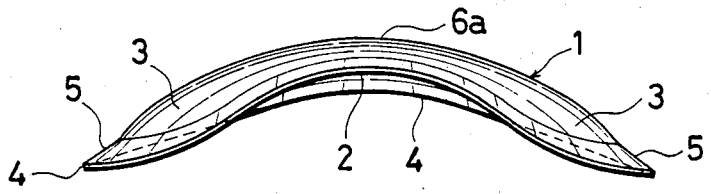
FIG. 2 is a front elevation of the wig attaching member of FIG. 1.
Figure 3:
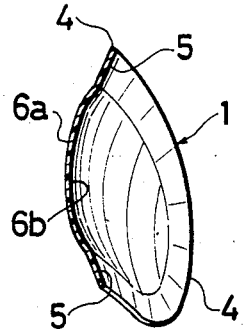
FIG. 3 is is a cross section taken along the line 3—3 of FIG. 1.
Figure 4:
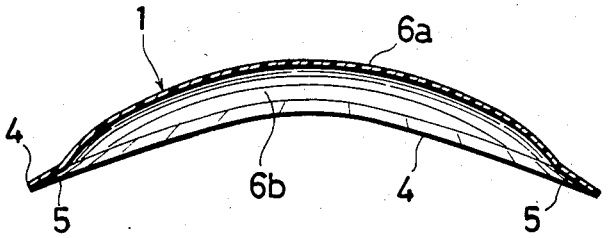
FIG. 4 is a longitudinal section taken along the line 4—4 of FIG. 1.

The member 1 is convexo-concave in shape so as to provide a substantially spherical external convex surface 6*a* and a substantially spherical internal concave surface 6*b*, as best shown in FIGS. 3 and 4. The member 1 is substantially arcuate not only in its longitudinal sectional end but also in its cross sectional end, as shown in FIGS. 3 and 4. The marginal edge 4 defining the indentation 2 may also be arcuate when viewed horizontally from the front side as shown in FIG. 2. In other words, the marginal edge 4 extends substantially along a surface configuration of the bald area of the wearer's head. The member 1 is easily deformable when pressed but can instantly restore its original shape upon removal of the pressure.

In use, the member 1 is fixed to an internal surface of a wig 9 by means of a known adhesive 15 or any other known fixing technique. More specifically, the member 1 is applicable to such a particular type wig 9 which comprises a wig body in the form of a hair supporting base 8 formed of synthetic resin made flexible film or net to which plural strands of artificial or real human hair 7 are secured at their roots, conventionally. The hair supporting base 8 is flexible enough not to prevent the elastic deformation of the member 1. More specifically, the member 1 is fixed at its substantially spherical convex external surface 6*a* to the internal surface of the hair supporting base 8 by means of the adhesive 15 for example. A position on the base 8 at which the member 1 is to be fixed can be freely selected in accordance with a location where a bald area of a person's head exists. However, the wig 9 per se does not constitute an important feature of the invention, and therefore, further detailed description of the wig per se is not given herein.

Incidentally, reference numeral 14 designates the wearer's natural hair, and the wig may preferably be designed so as to look natural with respect to the natural hair 14.

The member 1, which supports the wig 9, can be easily attached to a bald area 11 of the person's head 10 by placing it on the bald area 11 and then simply pressing it against the scalp of the bald area 11 with the wearer's hand so that a vacuum chamber 13 can be formed between the surface of the scalp of the bald area 11 and the internal surface 6*b* of the member 1. Provision of the indentation 2 and the pair of promontories 3 contribute to easy formation of the vacuum chamber 13.

The vacuum chamber 13 thus formed keeps the member 1 attached to the bald area 11 of the wearer's scalp by a negative pressure existing in the chamber 13. In other words, the member 1 serves as a sucker.

Figure 10:
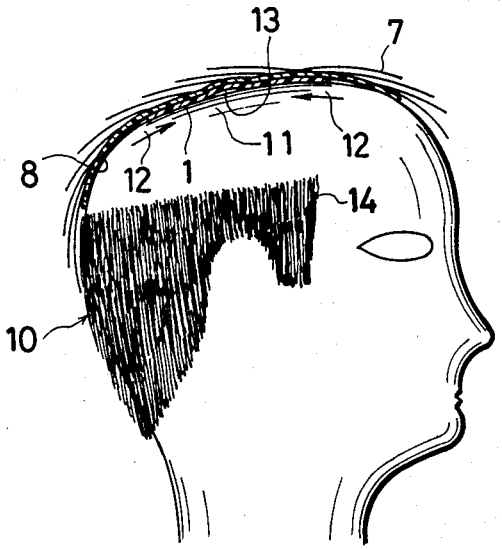
FIG. 10 is a similar view to FIG. 9, but showing the wig with the wig attaching member properly attached to a bald area of a wearer's head by means of negative pressure produced in a formed vacuum chamber.
Figure 11:
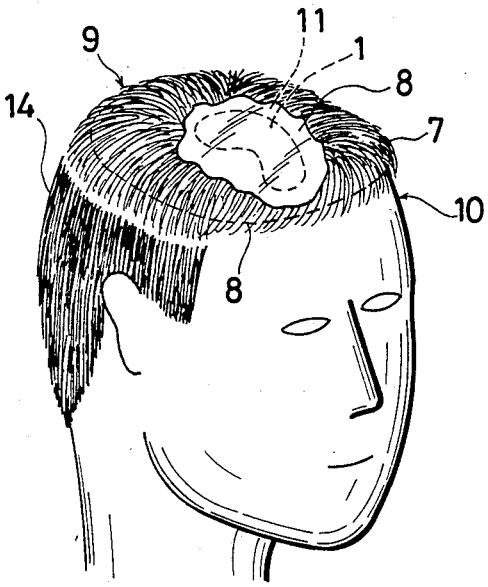
FIG. 11 is a schematic perspective view showing the wig with the wig attaching member in use with a central part of the wig broken away for clarity.

Once the member 1 with the wig 9 is attached to the bald area 11 in the manner as described, the skins 12 of the area 11 is sucked in the directions of arrows in FIG. 10 thereby to provide a tensioned smooth surface of the area 11, resulting in that the flat surfaced marginal zone 5 or the edge 4 can be in tight contact with the tensioned surface of the scalp with an air-tight relationship with each other. Thus, the member 1 with the wig 9 can be firmly attached to the bald area 11 without any unexpected dislocation.

Since the marginal edge of the member 1 is defined by a smoothly continuous curved edge 4 having no angular corner, the possibility of undesirable penetration of ambient air into the vacuum chamber 13 can be minimized.

When the bald area 11 gets wet for example by sweat on an individual's scalp or water in a bath or a swimming pool, the moisture serves as liquid seal for preventing ambient air from penetrating into the vacuum chamber 13. Thus, the moisture existing around the marginal edge of the member 1 gives not a bad but a good effect on adherence of the member 1 to the scalp.

The member 1 with the wig 9 can be easily removed from the bald area 11 by slightly raising a portion of the marginal edge 4 with fingers so that ambient air can enter into the vacuum chamber 13 for elimination of the negative pressure therein.

Size and configuration of the member 1 should be selected in accordance with those of the bald area 11. For instance, in the case where the bald area 11 is substantially circular, the member 1 may be of such a circle as having a diameter smaller than that of the circular bald area 11. On the other hand, in the case where the bald area 11 is substantially oval, the member 1 which is substantially oval in shape as shown in FIG. 5 or 6 may be employed.

The wig 9 supported by the member 1 can minimize a wearer's uncomfortable feeling in use, because the member 1 is light in weight, not rigid and not bulky and because the member 1 can be attached to the bald area 11 merely by means of negative pressure produced in the vacuum chamber 13 without the aid of any other additional attaching means such as an adhesive, a double-sided adhesive tape or mechanical anchoring members.

The present invention being thus described, it will be obvious that same may be varied in many ways. Such variations are not to be regarded as a departure from the spirit and scope of the invention, and all such modifications as would be obvious to those skilled in the art are intended to be included within the scope fo the present invention.

I claim:

1. A wig attaching member to be fixed to an inner surface of a wig, comprising:

a substantially convexo-concave sheet-like member which includes a smooth continuous curved marginal edge, a substantially spherical external convex surface and a substantially spherical internal concave surface;

said marginal edge being formed to be in tight contact with a bald area of a wearer's scalp thereby to provide an airtight relationship between said marginal edge and said bald area;

said member being elastically deformable when pressing force is applied thereon and restorable when said pressing force is removed therefrom, so as to provide an internal space serving as a vacuum chamber which is formed between said internal concave surface and said bald area when said member is pressed against said bald area by said pressing force and then released from said pressing force;

negative pressure existing in said vacuum chamber keeping said member attached to said bald area; and said member being detachable from said bald area when ambient air is introduced into said chamber to eliminate said negative pressure.

2. The wig attaching member as defined in claim 1, wherein said marginal edge extends substantially along a surface configuration of said bald area of a person's head.

3. The wig attaching member as defined in claim 1, wherein said member has a flat surfaced marginal zone extending along said marginal edge.

4. The wig attaching member as defined in claim 1, wherein said member is about 0.5 mm in wall thickness and formed of synthetic resin.

5. A wig attaching member to be fixed to an inner surface of a wig, comprising:

a substantially convexo-concave sheet-like member which includes a smooth continuous curved marginal edge, an indentation and a pair of promontories located on either side of said indentation as viewed from above and a substantially spherical internal concave surface;

said marginal edge being formed to be in tight contact with a bald area of a wearer's scalp thereby to provide an airtight relationship between said marginal edge and said bald area;

said member being elastically deformable when pressing force is applied thereon and restorable when said pressing force is removed therefrom, so as to provide an internal space serving as a vacuum chamber which is formed between said internal concave surface and said bald area when said member is pressed against said bald area by said pressing force and then released from said pressing force;

negative pressure existing in said vacuum chamber keeping said member attached to said bald area; and said member being detachable from said bald area when ambient air is introduced into said chamber to eliminate said negative pressure.

6. A wig attaching member according to claim 5, wherein said marginal edge extends substantially along a surface configuration of said bald area of a person's head.

7. A wig attaching member according to claim 5, wherein said member has a flat surfaced marginal zone extending along said marginal edge.

8. A wig attaching member according to claim 5, wherein said member is about 0.5 mm in wall thickness and formed of synthetic resin.

* * * * *